United States Patent [19]

Wagle et al.

[11] Patent Number: 4,818,342

[45] Date of Patent: Apr. 4, 1989

[54] HEAT TREATMENT OF PAPER PRODUCTS

[75] Inventors: Dinkar G. Wagle, Monroe; Vacheslav M. Yasnovsky, Orangeburg, both of N.Y.; Jerome M. Floyd, Mobile, Ala.

[73] Assignee: International Paper Company, Purchase, N.Y.

[21] Appl. No.: 103,004

[22] Filed: Sep. 30, 1987

Related U.S. Application Data

[63] Continuation-in-part of Ser. No. 768,643, Aug. 23, 1985, abandoned.

[51] Int. Cl.[4] ..... D21F 11/00

[52] U.S. Cl. ..... 162/207

[58] Field of Search ..... 162/135, 175, 168.1, 162/174, 202, 204, 206, 207

[56] References Cited

U.S. PATENT DOCUMENTS

| | | |
|---|---|---|
| 2,116,544 | 5/1938 | Schur . |
| 2,120,137 | 6/1938 | Mason . |
| 2,802,403 | 8/1957 | Boehm . |
| 3,354,035 | 11/1967 | Gottwald et al. . |
| 3,531,371 | 9/1970 | Jordansson et al. . |
| 3,533,906 | 11/1970 | Reiniger . |
| 3,560,297 | 2/1971 | Back et al. . |
| 3,677,850 | 7/1972 | Holt et al. . |
| 3,875,680 | 4/1975 | Back et al. . |
| 3,880,975 | 4/1975 | Lundmark . |
| 4,032,394 | 6/1977 | Back . |
| 4,385,172 | 5/1983 | Yasnovsky et al. . |

OTHER PUBLICATIONS

Norberg & Back, "Effect of Hot Pressing Temperature on the Properties of Hard and Semi-Hard Fibre Building Boards", Svensk Papperstidning, vol . 71, No. 15, pp. 774–787 (1968).

Back et al., "The Present State of Pres-Drying of Paper", Paper for 7th Fundamental Research Symposium (1981).

Anderson and Back, Untitled Paper Presented at European Conference (Oct. 1977).

Back, "Some Effects of Short Hot Prfess Nips on Wet Webs", date and place of publication unknown.

Back, "The Effect of Press Drying on Properties of Liner of High Yield Pulp", date and place of publication unknown.

Back et al., "The Dry, Hot Mouldability of Hardboard", Forest Products Journal, vol. 21, No. 9, pp. 96–100 (1971).

Back et al., "Bonding in Paper Webs Under Water-Deficient Conditions", Tappi Journal, vol. 62, No. 3, pp. 89–92 (1979).

Pease et al., "An Investigation Into the Effects of High Pressure Wet Pressing". . . Tappi Journal, vol. 45, No. 7, pp. 150–153A (1962).

Stenberg, "Effect of Heat Treatment on the Internal Bonding of Kraft Liner", Svensk Papperstidning No. 2, pp. 49–54 (1978).

Fraser, "Hot 'Mangle' Presses Thick Particleboard in Continuous Ribbon . . . ", date and place of publication unknown.

Setterholm et al., "Press Drying of High-Yield Hardwood Pulp", Criteria for Fiber Product Design (FS-F-PL-3306) (1976).

Back et al., "Wet Stiffness by Means of Heat Treatment of Running Web", *Pulp and Paper Canada,* vol. 78, No. 1 (1977), pp. 271–275.

Anderson and Back, "The Effect of Single Nip Press Drying . . . ", Pulp & Paper, Canada, vol. 77, No. 12, pp. 82–87 (1976).

Back et al, "Wet Stiffness by Heat Treatment of the Running Web", Pulp & Paper Canada, vol. 77, No. 12, pp. 97–106 (1976).

Back et al, "Wet Stiffness by Means of Heat Treatment of Running Web", Pulp & Paper Canada, vol. 78, No. 11, pp. 111–115 (1977).

Back et al., "Bonding in Paper Webs at Water Deficient Conditions", 1978-place of publication unknown.

Back et al., "Multistage Press Drying of Paper", reprint from Svensk Papperstidning, No. 2-197982 (1979), pp. 35–39.

Back, "The Relative Moisture Sensitivity of Compression . . . ", paper presented Oct. 1985 to Oxford Fundamental Research Symposium.

Seth et al., "The Effect of Press-Drying on Paper Strength", 1985 Papermakers Conference, pp. 249–256.

Setterholm et al., "Variables in Press Drying Pulps from Sweetgum and Red Oak", USDA For. Serv. Res. Paper FPL 295 (1977).

Setterholm, "An Overview of Press Drying", Tappi Journal, vol. 62, No. 3, pp. 46–46 (1979).

*Primary Examiner*—Peter Chin

*Attorney, Agent, or Firm*—Walt Thomas Zielinski

[57] ABSTRACT

The stiffness and wet strength of paper products are improved by subjecting the products to high temperature treatment, immediately followed by rewetting. The resultant products have good folding endurance.

3 Claims, No Drawings

HEAT TREATMENT OF PAPER PRODUCTS

BACKGROUND OF THE INVENTION

1. Field of the Invention

This invention relates to the art of papermaking, particularly to treating of formed paper product with heat and subsequent rewetting to improve its properties, including dry and wet stiffness, wet tensile strength and opacity.

2. Description of the Prior Art

In the art of papermaking, it is customary to subject felted fibers to wet pressing and then to drying on heated rolls.

There is currently considerable interest in improving various properties of paper and boards. Quantifiable paper properties include: dry and wet tensile strength, folding endurance, stiffness, compressive strength, and opacity, among others. Which qualities should desirably be enhanced depends upon the intended application of the product. In the case of milk carton board, for example, stiffness is of utmost importance whereas for linerboard, three qualities of particular interest to us are wet strength, folding endurance, and high humidity compression strength.

All of these properties can be measured by well-known standard tests. As used herein, then, "wet strength" means wet tensile strength as measured by American Society for Testing and Materials (ASTM) Standard D829-48. "Folding endurance" is defined as the number of times a board can be folded in two directions without breaking, under conditions specified in Standard D2176-69. "Stiffness" is defined as flexural rigidity and is determined by the bending moment in g-cm. "Linerboard", as used herein, is a medium-weight paper product used as the facing material in corrugated carton construction. Kraft linerboard is linerboard made according to the kraft process, and is well known in the industry. Folding carton board is a medium to heavy weight paper product made of unbleached and/or bleached pulps of basis weights from 40–350 g/m$^2$.

Prior workers in this field have recognized that high-temperature treatment of linerboard can improve its wet strength. See, for example E. Back, "Wet stiffness by heat treatment of the running web", *Pulp & Paper Canada,* vol. 77, No. 12, pp. 97–106 (December 1976). This increase has been attributed to the development and cross-linking of naturally occurring lignins and other polymers, which phenomenon may be sufficient to preserve product wet strength even where conventional synthetic resins or other binders are entirely omitted.

It is noteworthy that wet strength improvement by heat curing has previously been thought attainable only at the price of increased brittleness (i.e., reduced folding endurance). Embrittled board is not acceptable for many applications involving subsequent deformation, and therefore heat treatment alone, to develop the wet strength of linerboard and carton board, has not gained widespread acceptance. As Dr. Back has pointed out in the article cited above, "the heat treatment conditions must be selected to balance the desirable increase in wet stiffness against the simultaneous embrittlement in dry climates." Significantly, in U.S. Pat. No. 3,875,680, Dr. Back has disclosed a process for heat treating already manufactured corrugated board to set previously placed resins, wherein the specific purpose is to avoid running embrittled material through a corrugator.

It is plain that improved stiffness and wet strength, on one hand, and improved folding endurance, on the other, where previously thought to be incompatible results.

It is therefore an object of the invention to produce paper product having both improved stiffness and wet strength, and improved folding endurance. Another goal is to achieve that objective without resorting to synthetic resins or other added binders.

With a view to the foregoing, a heat treatment process has been developed which dramatically and unexpectedly increases not only the stiffness and wet strength of different boards, but also preserves their folding endurance. In its broadest sense, the invention comprises steps of (1) heating a board produced from either unbleached or bleached kraft pulp to an internal temperature of at least 400° F. (205° C.) for a period of time sufficient to increase the wet strength of the board; and (2) rewetting the board immediately after the heat treatment to at least 1% moisture by weight. These steps are followed by conventional drying and/or conditioning of the treated board. It is to be understood that steps 1 and 2 can be repeated several times.

This method produces a product having folding endurance greatly exceeding that of similar board whose stiffness and wet strength have been increased by heat alone. This is clearly shown by our tests exemplified below.

Of course, those skilled in the art will recognize the necessity of the product conditioning to a normal moisture content after this very hot treatment. See, for example, U.S. Pat. No. 3,395,219. A certain amount of rewetting is normally done, and in fact product properties are never even tested prior to conditioning. All conventional rehumidification is done after the product has substantially cooled.

Our treatment principally differs from conditioning in that we add water, by spraying or otherwise, to a very hot and dry paper or board at the very end of the heat treatment, without intermediate cooling. It is critical to our process that water be applied to the product while it is still hot, certainly above 100° C. (212° F.), and preferably above 205° C. (400° F.). Another heat treatment or drying step may follow rewetting, on or off the machine, during a subsequent operation such as sizing, coating or calendering.

While the invention may be practiced over a range of temperatures, pressures and duration, these factors are interrelated. For example, the use of higher temperatures requires a heat treating step of shorter duration, and vice-versa. For example, at 550° F. (289° C.), a duration of 2 seconds has been found sufficient to obtain the desired improvements, while at 420° F., considerably longer is required.

We prefer to raise the internal temperature of the board to at least 450° F. (232° C.) during the heat treating step, as greater stiffness and wet strength are then achieved. This may be because at high temperatures, shorter step duration is necessary to develop bonding, and there is consequently less time for fiber degradation to occur. Also, shorter durations enable one to achieve high production speeds.

DESCRIPTION OF THE PREFERRED EMBODIMENT

The invention will preferably be practiced on a papermaking machine, although our test data below is of samples produced in a static press. Whatever the apparatus, the water content of the web must first be reduced to not more than 20% by weight and preferably to within the 10–15% range. Sufficient heat is then applied to the board to achieve an internal paper temperature of at least 400° F. (205° C.). The heat can be applied in the form of hot air, superheated steam, heated drying cylinders, infrared heaters, or by other means.

Alternatively, the invention may be practiced by heating paper product in an oven after a size-press. The internal temperature of the board should be brought to at least 400° F. for at least 10 sec. Again, the nature of the heat source is not important.

Following the heat treating step, and while the paper is still hot, water is applied to it, preferably by spraying. (Even though one effect of the water application is to cool the paper, it is important that the paper not be allowed to cool substantially before the water application. Paper temperature must remain above 100° C. until water is applied.) Thereafter, the heat treated and rewetted paper is then cooled, conditioned, and calendered according to conventional procedure.

The invention has been practiced as described in the following examples. The improvement in board quality will be apparent from an examination of the test results listed in the tables below.

EXAMPLE 1

A bleached kraft board with ambient moisture content of 5.0% (no HT) was tested for various properties of interest in both the machine direction ("MD" in the table) and the cross-machine direction ("CD"). A portion of the board was then heat treated at 410° F. (210° C.) for 15 seconds ("HT"). A portion of the heat-treated board was immediately rewetted to 10.6% moisture content and then dried conventionally (HT and RW). Both samples were conditioned for 48 hours at 70° F. (21° C.), 65% relative humidity and were then tested. Properties of these samples are given in Table I.

TABLE I

| Property | Control Sample (no HT) | Heat Treated (HT) | Rewetted Sample (HT&RW) |
|---|---|---|---|
| Basis weight (lb/3000 ft$^2$) | 153.4 | 154.0 | 154.3 |
| Caliper (mils) | 15.7 | 15.8 | 15.0 |
| Taber stiffness MD/CD (g-cm) (corrected for basis weight) | 121/60 | 131/72 | 127/71 |
| % stiffness improvement MD/CD | — | 8.3/20.0 | 5.0/18.3 |
| MIT Fold counts MD/CD | 98/75 | 85/70 | 131/55 |

It can be seen that heat treating alone produces a substantial increase in stiffness, but some reduction in folding endurance. The latter property is restored, and more, by rewetting, which causes only a slight decrease in stiffness. The net result is a significant improvement in both properties.

EXAMPLE 2

A bleached kraft board identical to that used for Example 1 was wetted to 10.2% moisture content and heat treated at 406° F. (208° C.) for 9 seconds (HT). A portion of the heat-treated board was immediately rewetted to 1.5% moisture content and then was heat treated under same conditions again for 9 seconds (HT and RW). Both samples were conditioned for 24 hrs. under standard conditions and were then tested. Properties of these samples are given in Table II.

TABLE II

| Property | Control Sample (no HT) | Heat Treated (HT) | Rewetted Sample (HT&RW) |
|---|---|---|---|
| Basis weight (lb/3000 ft$^2$) | 153.4 | 154.5 | 155.3 |
| Caliper (mils) | 15.7 | 16.6 | 16.1 |
| Taber stiffness MD/CD (g-cm) | 121/60 | 132/60 | 133/67 |
| Wet Tensile Strength MD/CD (lb/in) | 2.5/1.6 | 5.7/3.6 | 5.0/3.7 |
| % Wet/Dry Tensile MD/CD | 6.6/4.4 | 14.9/9.4 | 10.3/7.5 |
| Cracking resistance % not cracked MD/CD | 100/100 | 85/7 | 94/58 |

The steps of heat treating followed immediately by rewetting doubled wet strength and improved stiffness of the paperboard, with only a slight degradation of other properties. Rewetting was necessary to prevent the severe embrittling caused by heat treatment alone, and was measurably more effective than normal "conditioning".

EXAMPLE 3

Another sample of linerboard was wetted to 8.5% moisture content and then tested for various properties of interest (no HT). A portion of the board was then heat treated at 464° F. (240° C.) for 10 seconds (HT). A portion of the heat-treated board was immediately rewetted to 7.6% moisture content (HT and RW) and then dried conventionally. Both samples were conditioned for 24 hours under standard conditions and tested. Properties of these samples in the machine direction only are given in Table III.

TABLE III

| Property | Control Sample (no HT) | Heat Treated (HT) | HT & Rewetted (HT&RW) |
|---|---|---|---|
| Basis weight (lb/3000 ft$^2$) | 43.1 | 43.0 | 42.8 |
| Caliper (mils) | 12.7 | 13.1 | 12.8 |
| L & N Stiffness (g-cm) | 53 | 62 | 58 |
| STFI Compression Strength (lb/in) | 41.0 | 48.3 | 47.8 |
| Wet Tensile Strength (lb/in) | 5.7 | 19.9 | 24.3 |
| Folding Endurance cycles to failure | 854 | 449 | 751 |

Heat treating and rewetting notably improved strength and stiffness properties with only a minor reduction in folding endurance. In all the above examples, folding endurance following our treatment was at least 85% that of the original board.

Inasmuch as the invention is subject to many variations and changes in detail, the foregoing description and examples should be taken as merely illustrative of the invention defined by the following claims.

We claim:

1. A method of improving the stiffness and strength of a kraft paper product while maintaining acceptable flexibility thereof comprising steps of heat treating incompletely dried or moisturized paper product, at high temperature within the range of 284° F. to 482° F. for 0.5 seconds to 120 seconds, and then rewetting the surface of said product immediately following said heat treating step, said product being maintained above 212° F. during the interval between the heat treating and rewetting steps.

2. The method of claim 1, wherein the product has an initial moisture content in the range of 1.0 to 40% by weight before said heat treating step.

3. The method of claim 1, wherein during the rewetting step, the product is rewetted to a moisture content in the range of 1.0 to 20% by weight.

* * * * *